US005147124A

United States Patent [19]

Grass et al.

[11] Patent Number: 5,147,124

[45] Date of Patent: Sep. 15, 1992

[54] FALSE FRONT WITH ADJUSTMENT DEVICE

[75] Inventors: Alfred Grass, Hochst/Vlbg.; Ingo Gasser, Höchst, both of Austria

[73] Assignee: Grass AG, Hochst/Vlbg., Austria

[21] Appl. No.: 580,266

[22] Filed: Sep. 10, 1990

[30] Foreign Application Priority Data

Sep. 14, 1989 [DE] Fed. Rep. of Germany ..... 3930662

[51] Int. Cl.[5] ..... A47B 88/00

[52] U.S. Cl. ..... 312/348.4

[58] Field of Search ..... 312/348.4, 263, 257.1, 312/330.1

[56] References Cited

U.S. PATENT DOCUMENTS 4,846,538 7/1989 Rock et al. ..... 312/330.1
4,850,659 7/1989 Rock et al. ..... 312/330.1
4,874,212 10/1989 Rock et al. ..... 312/330.1

*Primary Examiner*—Joseph Falk

[57] ABSTRACT

A front panel with adjustment device, particularly for drawers of kitchen furniture with a frame with side frame rails with rollers and further with a rail arranged on the side of the frame and connected with the back side and front panel provides for adjustment of the incline of the front panel, with an adjustment device arranged between the rail and the front panel. Provided for this purpose is a gear housing attached to the forward end of the rail, an eccentric bolt of a pinion engaging a receiving slot of the rail, and a worm with slots meshing with the pinion through a tooth system.

5 Claims, 4 Drawing Sheets

FALSE FRONT WITH ADJUSTMENT DEVICE

BACKGROUND OF THE INVENTION

The invention relates to a false front with adjustment device, particularly for drawers of kitchen furniture with a frame with side frame rails with rollers and further with a rail arranged on the side of the frame and connected with the false front of the drawer, incline of the false front being capable of adjustment with an adjustment device arranged between the rail and the false front.

Drawers of kitchen furniture or the like have a frame with a bottom and side walls, the frame rail itself with the rollers arranged thereon often respresenting the lateral boundary of the drawers, the frame rail as a kind of pull-out rail moving on guide rollers of a further rail on the body of the furniture unit. The drawers also have a rear wall and a false front along with a rail in a raised arrangement above the side walls of the drawer between the rear wall and the false front in order to prevent tipping of tall objects or bottles and the like. The problem posed here is to be able to adjust the incline of the false front of the drawer when the frame is mounted with a rail arranged above the side walls.

A false front with adjustment device of the type mentioned in the beginning is already known, the rail being pipe-shaped and the rail shapes being mounted radially in a rail flange and guided in axial displacement, a driver clip with an adjusting screw being arranged in the rail flange. When the adjusting screw is turned, the false front is set by the rail in the desired incline, this false front incline being capable of adjustment in small ranges. The false front is also fastened in the bottom area of the drawer with screw-on angle brackets, their fastening being loosened slightly for adjustment of the incline of the false front, or the screw-on angle brackets deform slightly without the need for the fastening to be loosened when the incline of the false front is adjusted.

In this type, aligned edges and forward faces of the drawer fronts can be aligned with other furniture edge surfaces. Dimension variations are unavoidable in furniture manufacturing and are thus compensated in assembly by adjustment devices.

SUMMARY OF THE INVENTION

The object of the invention is to provide a false front with adjustable incline with an adjustment device that is simple to operate and clearance-free when using a rail having a simple construction.

The invention achieves this object in that a gear housing is attached to the forward end of the rail, an eccentric bolt of a pinion engaging a receiving slot of the rail, and a worm with adjusting slots meshing through a tooth system with the pinion.

The essential feature of the invention is that the false front is forced down from the rail by an eccentric bolt, which is actuated through a worm, and the pinion is arranged in a gear housing, which is supported on the false front.

It is advantageous here for the gear housing to have a bent leg in the direction of the false front, which is connected with a guide component arranged on the front side of the rail and supported with the guide component on the false front.

The leg and the guide component have boreholes here and are penetrated by screws for fastening on the false front.

In an advantageous development, the gear housing and the forward area of the rail with the guide component and the leg are protected by a cover cap with two flanges.

It is advantageous here for the adjusting slots of the worm to be accessible from the side of the drawer through the cover cap.

BRIEF DESCRIPTION OF THE DRAWINGS

The invention is explained in more detail below using drawings that represent an example embodiment.

DESCRIPTION OF THE PREFERRED EMBODIMENT

Figure 1:
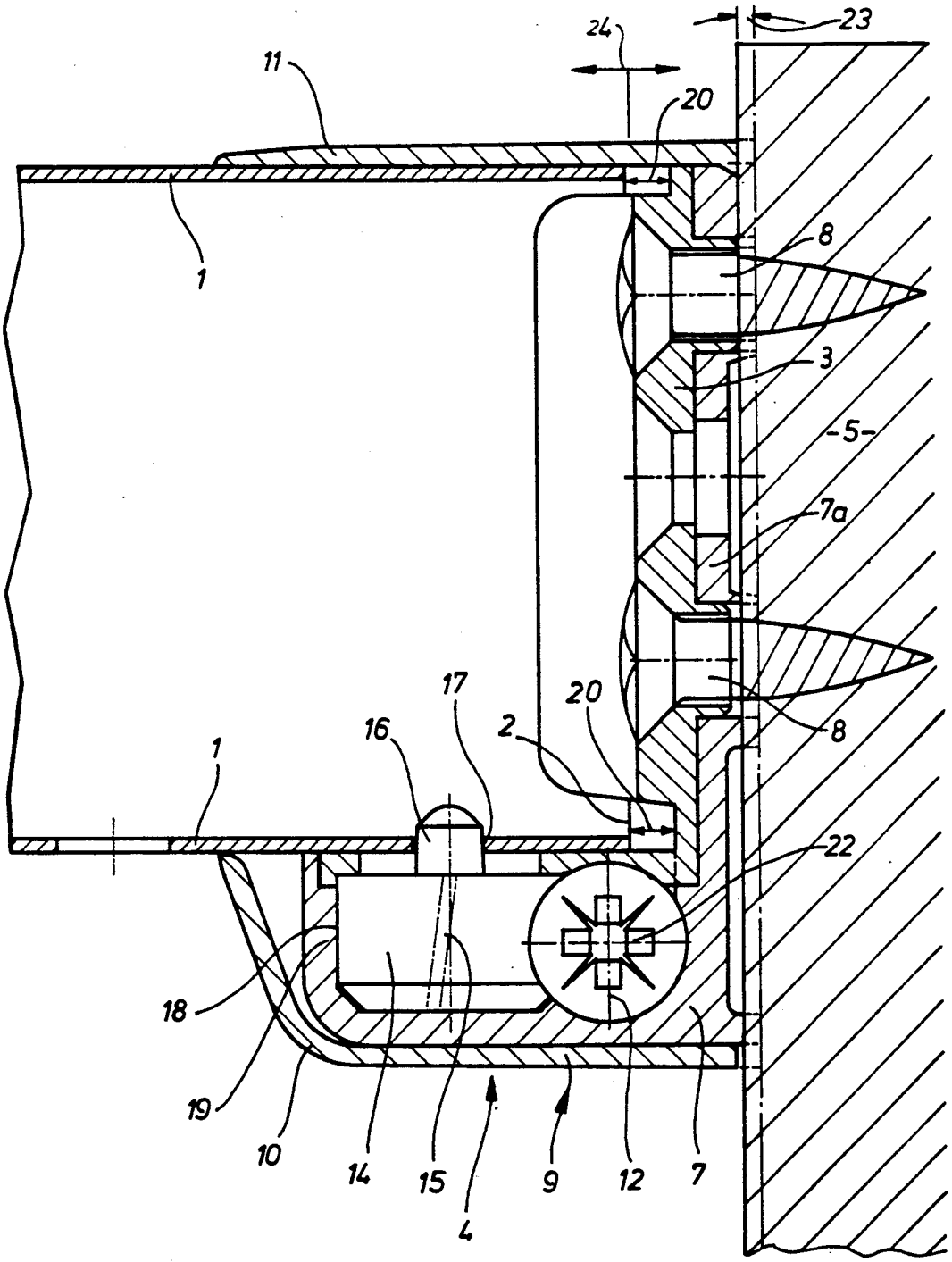
FIG. 1 is a longitudinal section of the forward area of a rail with attached adjustment device.
Figure 2:
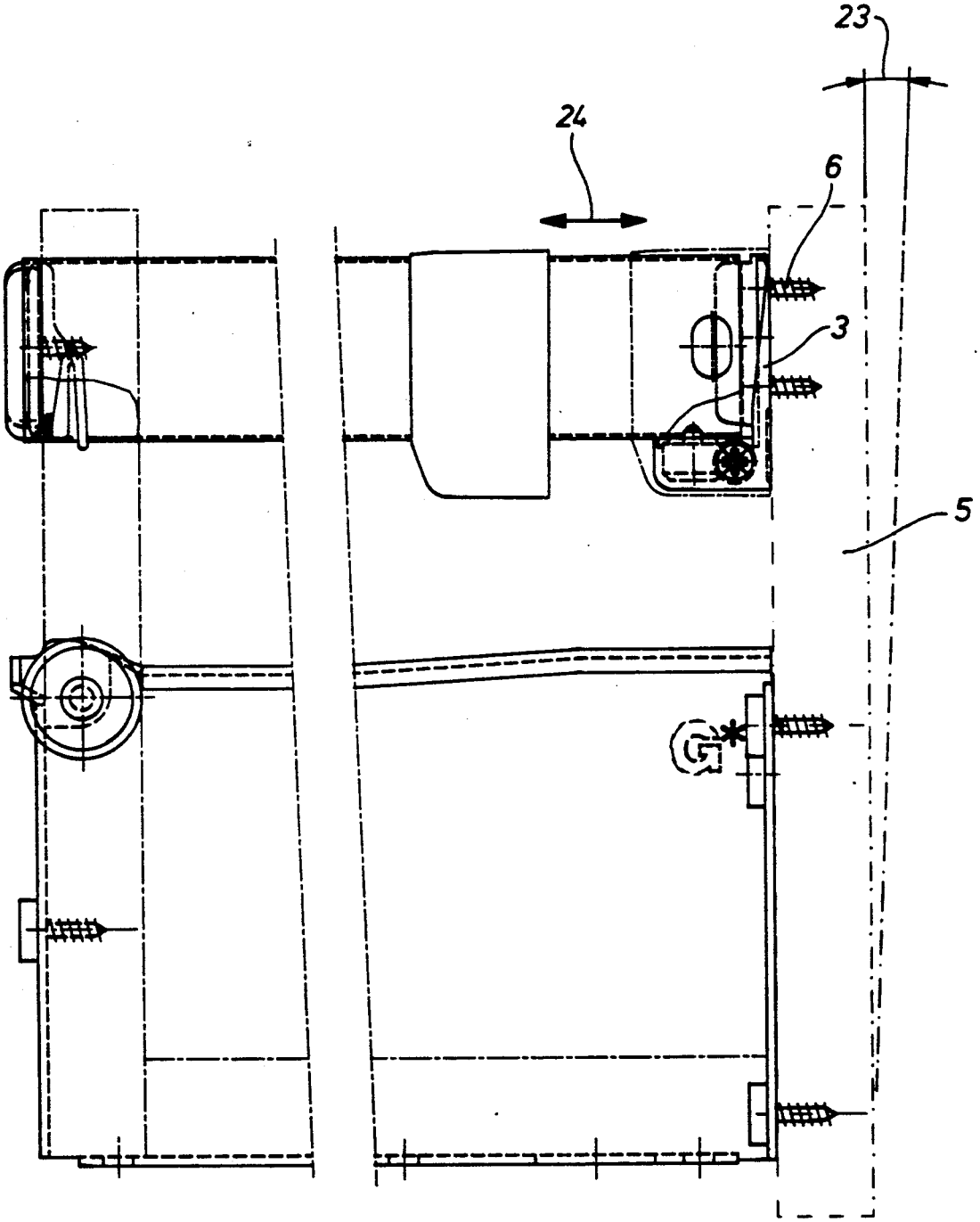
FIG. 2 is a side view of a drawer with false front and rear wall as well as with the rail with the adjustment device arranged between the rail and the false front.

FIG. 1 shows the adjustment device 4 for a false front 5 according to FIG. 2, the interval between the rail 1 fixed to the drawer and the false front arranged to be inclined thereto being adjusted in the range of an angle 23 according to FIG. 2.

The adjustment itself is carried out by forcing the false front 5 down away from the rail 1 in the arrow direction 24 in FIG. 2.

The rail, consisting preferably of one or more rail pipes 1, is connected at its rear part with the rear wall of the drawer, e.g., through plug-ins or other locking connections to form a rigid connection.

At the front part, the rail 1 is not supported directly on the front plate 5 according to FIG. 2, but rather the adjustment device 4 according to FIG. 1 is arranged between the rail 1 and the front plate 5.

The adjustment device consists essentially according to FIG. 1 of a gear housing 7, which is supported on the front panel 5 according to FIG. 2 and has a laterally bent leg *7a*, which is connected with a guide component 3.

The rail, which is a rail pipe 1 in the example embodiment, is penetrated by an eccentric bolt 16 of a pinion 14, the eccentric bolt 16 being supported on the rail pipe 1 when the worm 12 turns over adjustment slots 22, which displaces the gear housing 7 together with the leg *7a* and the guide component 3 in the direction of the front panel, the front panel being forced away from the rail pipe, which allows the incline of the front panel 5 to be adjusted in the range of the angular adjustment according to FIG. 2.

When the guide component 3 is forced down, that is, on displacement of the gear housing 7 with the leg *7a*, an interval 20 changes with respect to the end face 2 of the rail pipe 1, which causes the inclination of the front panel 5.

The front panel 5 is screwed on this guide component 3 with screws 6 in accordance with FIG. 2.

Screw holes 8 are provided for this purpose as shown in FIG. 1.

The adjustment device 4 consists essentially of a gear housing 7, which is mounted on the guide component 3 and protected on the outside by a cover cap 9.

Figure 4:
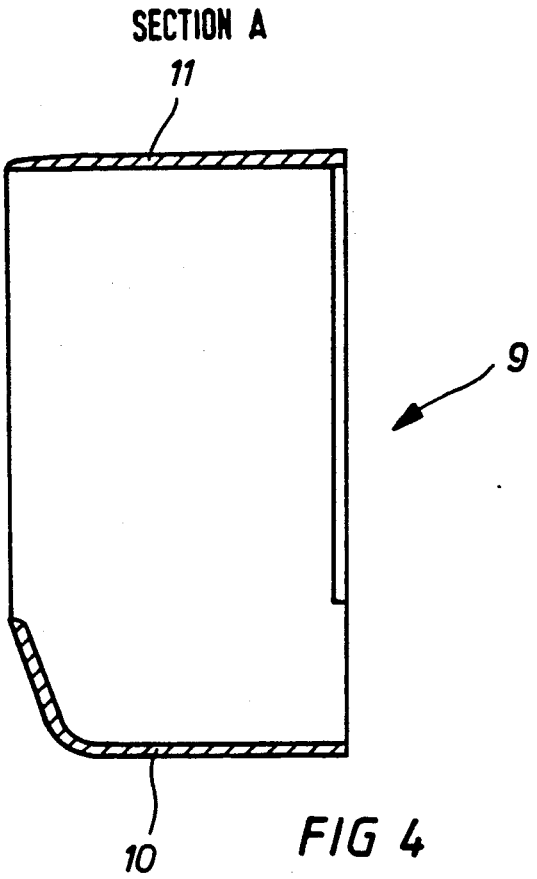
FIG. 4 is a sectional view of the cover cap.
Figure 3:
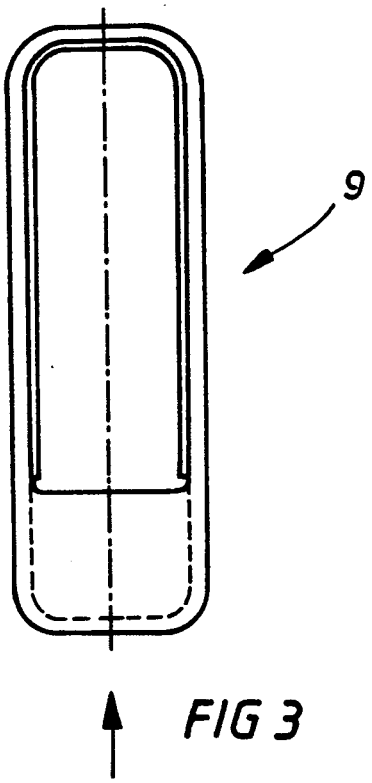
FIG. 3 is a view of the cover cap.
Figure 4A:
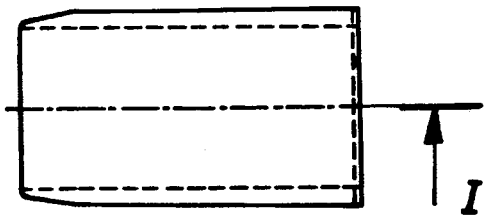
Figure 3A:
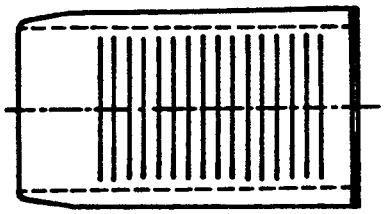

The cover cap is shown in greater detail in FIGS. 3 and 4.

The cover cap 9 consists essentially of two side flanges 10, 11, the two flanges 10, 11 being attached to the side surfaces of the rail 1.

Figure 5:
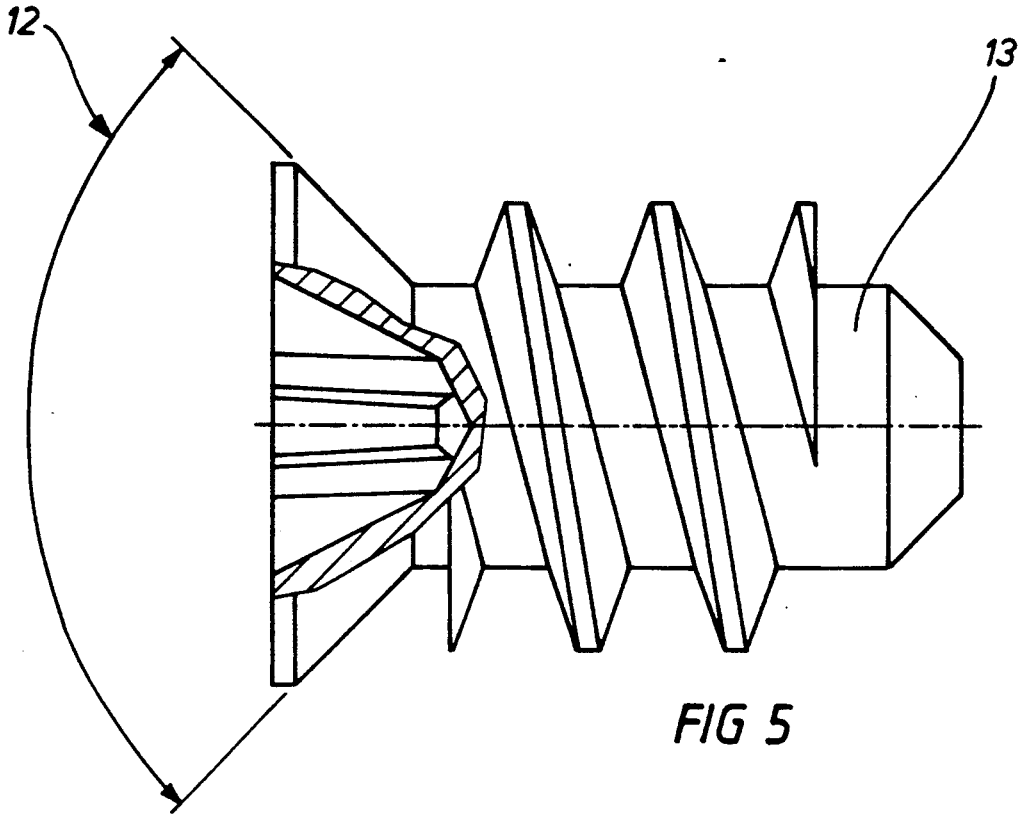
FIG. 5 shows the worm for actuating the pinion.

A worm 12 is pivot-mounted according to FIG. 5 in the gear housing, bolt end 13 centered on the axis of rotation being seated in a suitable receiver borehole of the gear housing 7.

The worm 12 meshes with a pinion 14, which has a helical tooth system 15 and an eccentric bolt 16 with which the pinion 14 is held in a suitable receiving slot 17 in the side wall of the rail 1 or engages the rail itself.

The slot 17 has an elongation vertical to the plane of the drawing of FIG. 1 so that, when the pinion 14 is turned, the eccentric bolt 16 can move up and down vertically with respect to the plane of the drawing without displacement occurring, but when there is a displacement parallel to the longitudinal axis of the rail, the peripheral walling 18 of the pinion 14 lies on the corresponding housing walling 19 of the gear housing 7, so that the peripheral walling is forced down here and the entire gear housing is displaced along the rail.

Thus, the cover cap 9 and the gear housing 7 and the guide component 3 are displaced on the rail, which changes the interval 20.

The incline of the front panel is then adjusted because the front panel is connected, to be tilted in a way not shown in detail, at its lower edge with the bottom of the drawer, this bottom fastening being slightly distorted when the incline of the front panel is adjusted.

Figure 6:
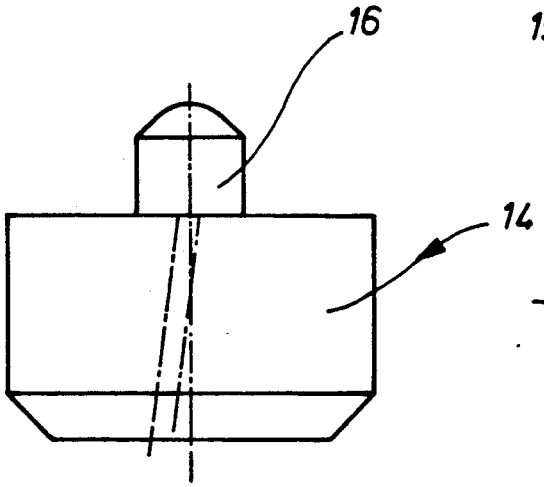
FIG. 6 is a top view of the pinion with eccentric bolt.
Figure 7:
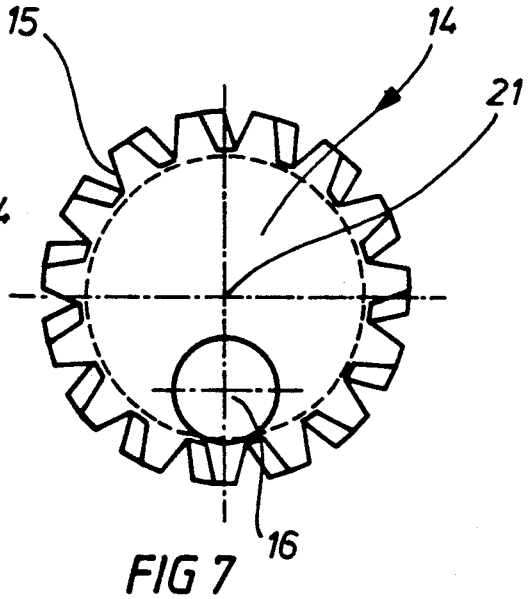
FIG. 7 is a view of the pinion with eccentric bolt and tooth system.

FIGS. 6 and 7 show this pinion, and it can be seen that the eccentric bolt 16 is in a quite eccentric arrangement from the pinion to the pivot point.

This type of adjustment device 4 is arranged on both sides of the drawer front panel at the end face thereof, so that both adjustment devices can be adjusted separately from each other, hence adjustment parallel to the end face of the body of the furniture unit is also possible.

What is claimed is:

1. A device for adjusting the incline of a false front of a drawer of the type having a drawer back and respective side frame rails connected to the drawer back, comprising:

a gear housing attachable to the false front;

a worm rotatably supported in said gear housing;

a pinion meshing with said worm and having portions defining an eccentric bolt;

the respective side frame rails each having a forward end including portions defining a receiving slot, and said eccentric bolt slidably engaging said receiving slot of a respective side frame rail and, upon rotation of said worm and thus said pinion and eccentric bolt, displacing said gear housing and thus said false front in directions toward and away from said forward end of said respective side frame rail.

2. A device according to claim 1 wherein said gear housing has portions defining a leg, and further comprising a guide component engaging said leg.

3. A device according to claim 2 wherein said guide component has at least one hole formed therein, and further comprising at least one fastening screw insertable in said hole for attaching said guide component and said leg to said false front.

4. A device according to claim 1 further comprising a cover cap embracing said gear housing and said forward end of said side frame rail.

5. A device according to claim 4 wherein said cover cap has portions defining a hole affording access to said worm from exterior of said cover cap.

* * * * *